United States Patent [19]

Henderson, Jr. et al.

[11] 4,177,504

[45] Dec. 4, 1979

[54] LUMINAIRE REFLECTOR MOUNTING FOR ROTATION OF ASYMMETRIC REFLECTOR

[75] Inventors: Alfred J. Henderson, Jr., Chagrin Falls, Ohio; Thomas A. Fletcher, Dana, N.C.

[73] Assignee: General Electric Company, Schenectady, N.Y.

[21] Appl. No.: 848,544

[22] Filed: Nov. 4, 1977

[51] Int. Cl.[2] ..... F21V 17/02

[52] U.S. Cl. ..... 362/282; 362/322; 362/350; 362/366; 362/371; 362/429

[58] Field of Search ..... 362/84, 145, 282–284, 362/322–325, 350, 366, 371, 372, 429

[56] References Cited

U.S. PATENT DOCUMENTS

| | | | |
|---|---|---|---|
| 1,259,576 | 3/1918 | Winston | 362/269 |
| 1,611,902 | 12/1926 | Foster | 362/374 |
| 1,958,627 | 5/1934 | Kurtz | 362/350 |
| 2,011,868 | 8/1935 | Michel | 362/350 |
| 2,249,357 | 7/1941 | Graham | 362/287 |
| 2,554,565 | 5/1951 | Fike | 362/284 |
| 2,611,073 | 9/1952 | Wheat | 362/284 |
| 2,921,181 | 1/1960 | Elmer | 362/297 |
| 2,945,945 | 7/1960 | Rex | 362/350 |
| 3,449,558 | 6/1969 | Whitmer | 362/84 |

*Primary Examiner*—Peter A. Nelson
*Attorney, Agent, or Firm*—Sidney Greenberg

[57] ABSTRACT

Mounting device for rotatable adjustment of asymmetric reflector within luminaire housing to vary the light distribution from the luminaire. The mounting device includes a plurality of brackets circumferentially spaced around the lower portion of the dome-shaped luminaire housing for supporting the circular rim of the asymmetric reflector, which is formed with a corresponding plurality of recesses for clearing the brackets when the asymmetric reflector is inserted in or removed from the luminaire housing. Adjustable clamps are arranged adjacent the brackets for securing the reflector in the desired rotational position.

5 Claims, 4 Drawing Figures

LUMINAIRE REFLECTOR MOUNTING FOR ROTATION OF ASYMMETRIC REFLECTOR

The present invention relates to luminaires, and particularly concerns a reflector mounting device for roadway lighting luminaires.

It is an object of the invention to provide an improved luminaire reflector mounting device for adjustably mounting the reflector within the luminaire housing.

It is a particular object of the invention to provide a mounting device of the above type for use with an asymmetric reflector wherein the reflector is rotatably adjustable to and securely held in different positions within the luminaire housing to vary the light distribution on the area to be lighted below the luminaire.

Other objects and advantages will become apparent from the following description and the appended claims.

With the above objects in view, the present invention in one of its aspects relates to a luminaire comprising, in combination, a concave housing having a bottom opening, a concave reflector arranged within the housing and having a rim defining a bottom opening substantially coaxial with the bottom opening of the housing, the rim of the reflector being formed with an annular upstanding flange spaced outwardly from the reflector, means for removably mounting a lamp in the reflector, the reflector being rotatably adjustable within the housing about the axis thereof, and a plurality of circumferentially spaced fastening means adjustably securing the reflector rim flange to the housing for holding the reflector in different rotational positions relative to said housing, whereby the light distribution from the reflector may be varied.

The invention will be better understood from the following description taken in conjunction with the accompanying drawings, in which.

Figure 1:
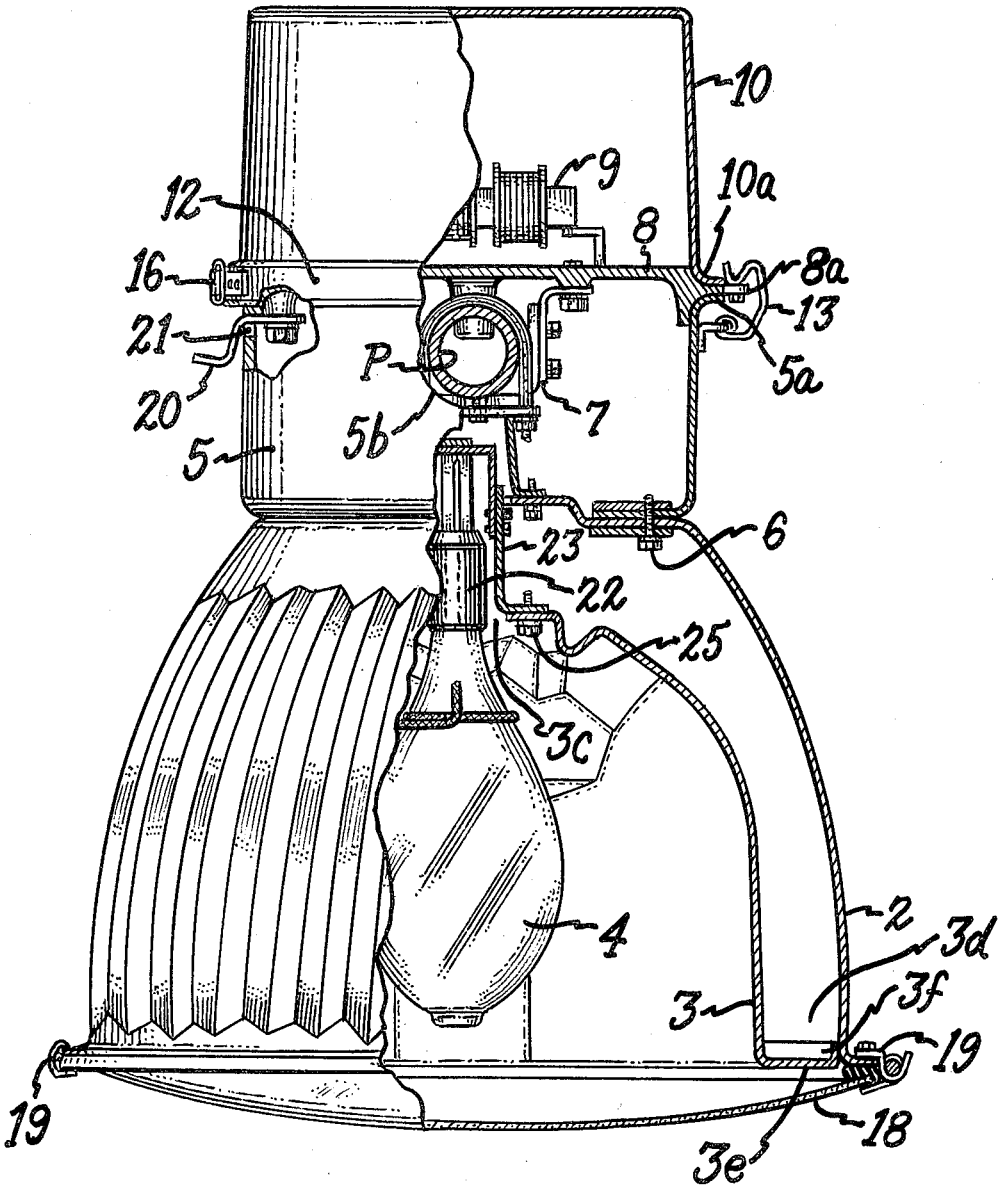
FIG. 1 is an elevational view, with parts broken away, of a luminaire embodying the invention.

Referring now to the drawings, and particularly to FIG. 1, there is shown a luminaire of a type in which the reflector mounting device of the invention may be embodied comprising an optical assembly 1 including dome-shaped housing 2 and lamp 4 which is typically a high intensity gaseous discharge lamp. An inner reflector 3 shown enclosed within housing 2 has a configuration for producing asymmetric distribution of reflected light, and is mounted in housing 2 for rotational adjustment about the vertical axis of the luminaire, as more fully disclosed below. The open bottom of housing 2 is closed by light transmitting closure 18 which is secured to the rim of housing 2 by clamp band 19 or other suitable means.

Secured at the top of optical assembly 1 by bolts 6 or the like is slipfitter housing 5 which is cylindrical in shape and has an open top defined by an outwardly flaring rim 5*a*. A U-shaped cutout 5*b* is provided in slipfitter housing 5 to allow passage of support pipe P on which the luminaire is fixedly mounted by means of adjustable slipfitter or pipe clamp 7.

Arranged covering the open top of slipfitter housing 5 is a circular disc-like mounting plate 8 seated on rim 5*a* with a correspondingly shaped lower mating surface on its periphery. Slipfitter 7 is secured to the underside of mounting plate 8, so as to be positioned within slipfitter housing 5. Details of the structure and operation of slipfitter 7 are more fully disclosed in co-pending application Ser. No. 840,069—Fletcher, filed Oct. 6, 1977, and assigned to the same assignee as the present invention.

Mounted on the upper side of mounting plate 8 are electrical operating components such as ballast transformer 9 for operating discharge lamp 4. Arranged on top of mounting plate 8 and enclosing the electrical components thereon is ballast housing 10 which is similar in shape to slipfitter housing 5 with a closed top and open bottom and has a flaring rim 10*a* at its bottom seated on the upper peripheral mating surface of mounting plate 8.

Embracing the annular joint thus formed by rims 5*a*, 10*a* and the intervening periphery of mounting plate 8 and locking the parts in assembly is clamp band fastener 12 which is formed of two sections respectively hinged on lug 8*a* projecting from mounting plate 8 and latched together at their free ends (not shown). At the hinged side of clamp band 12 is arranged spring clamp 13 of generally U-shaped hingedly secured to slipfitter housing 5 and resiliently bearing on the upper side of lug 8*a*. Further details of the structure and components of the illustrated luminaire and the manner of assembly and installation and other features thereof are disclosed in co-pending application Ser. No. 839,550—Fletcher, filed Oct. 5, 1977, and assigned to the same assignee as the present invention.

Lamp socket 22, in which lamp 4 is removably mounted, is secured by adjustable lamp positioning device 23 to auxiliary reflector 3 by bolts 25 or the like so that lamp 4 extends into reflector 3. The details of construction and operation of such a lamp positioning device are disclosed and claimed in co-pending application Ser. No. 846,735—Henderson et al, filed Oct. 31, 1977, and assigned to the same assignee as the present invention.

In accordance with the present invention, asymmetric reflector 3 is mounted within housing 2 by means of a mounting device which provides for reflector 3 to be rotationally adjustable relative to housing 2 about the axis thereof to any desired position for varying the reflected light distribution from the luminaire, and for securely locking the reflector in the selected rotational position. The reflector mounting arrangement is such, furthermore, that reflector 3 may be readily assembled into and removed from the luminaire housing.

Figure 3:
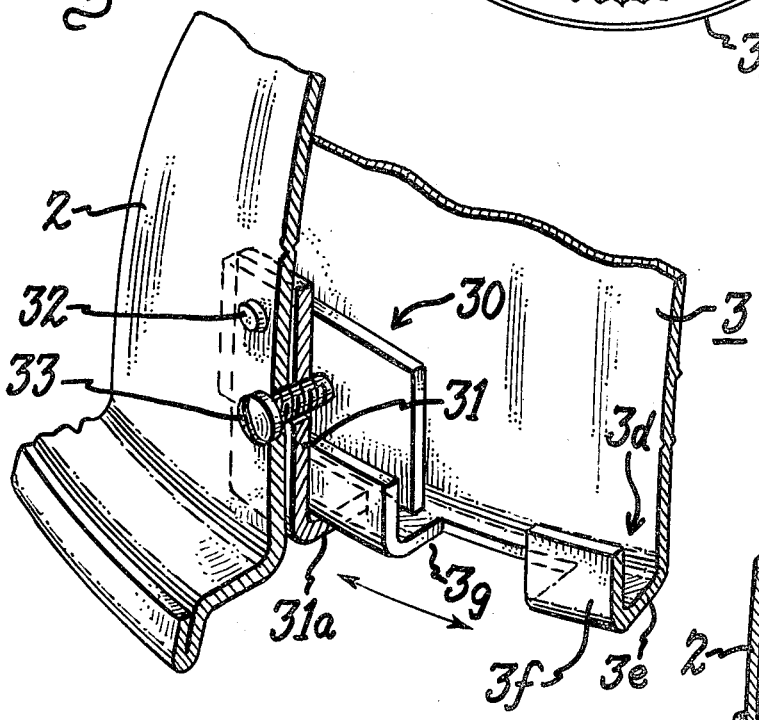
FIG. 3 is an enlarged perspective view of a portion of the luminaire showing the reflector mounting device.
Figure 4:
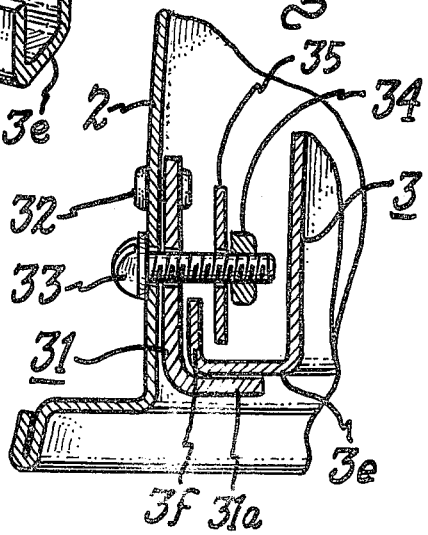
FIG. 4 is a cross-sectional view of the reflector mounting device shown in FIG. 3.

As seen in FIG. 1, reflector 3 is substantially dome-shaped and has at its open bottom channel-shaped rim 3*d* formed with a laterally extending web 3*e* and an annular upstanding flange 3*f* extending around the reflector spaced from its sidewall. Clamp means 30, typically three in number, are arranged uniformly spaced around the lower portion of housing 2 for clamping reflector 3 in operative position within housing 2. Each clamping means 30 comprises (see FIGS. 3 and 4) L-shaped bracket 31 secured to the inner surface of housing 2 by rivets 32 or the like so that its bottom leg 31*a* projects inwardly in housing 2 and serves as a support for reflector 3 which rests thereon at its rim 3*e*. Adjustably secured to the wall of housing 2 by screw 33 and captive nut 34 is retainer plate 35 which clamps reflector rim flange 3*f* to bracket 31 when screw 33 is tightened. The rim of reflector 3 is formed with three recesses 3*g* uniformly spaced around the reflector rim (see FIG. 2) to correspond with the circumferential positions of clamp means 30. Recesses 3*g* are wider and deeper than bracket legs 31*a*, so that when reflector 3 is rotated within housing 2 to a position where recesses 3*g* are adjacent brackets 31, the recesses clear bracket legs 31*a* to allow reflector 3 to be removed from housing 2. In assembling reflector 3 in housing 2, recesses 3*g* are aligned with brackets 31 to allow the reflector to be inserted into the housing. With the reflector inserted sufficiently so that its lowermost rim portion 3*e* is slightly above the level of bracket legs 31*a*, reflector 3 is then rotated with rim flange 3*f* passing between retainer plate 35 and bracket 31 so that the reflector may rest on bracket legs 31*a*. When a particular rotational position of the reflector is reached which provides the desired light distribution, screws 33 are then tightened to clamp the reflector in the selected position.

As seen in FIG. 1, lamp support 23 is secured to the top of asymmetric reflector 3 and passes upwardly through opening 3*c* in reflector 3 and freely through the central opening in the bottom of slipfitter housing 5. Thus, lamp support 23 with attached socket 22 and lamp 4 moves together with reflector 3 when the latter is rotated to the desired position as described above.

Figure 2:
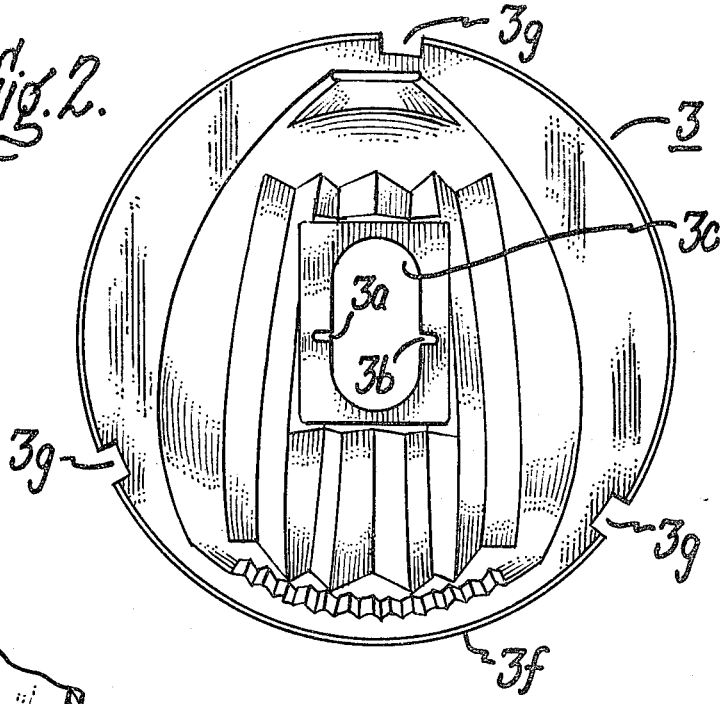
FIG. 2 is a top plan view of the reflector shown in the FIG. 1 luminaire.

The type of asymmetric reflector shown in FIG. 2 is such as to provide a reflected light distribution characterized by mirror symmetry about a vertical plane passing through the reflector from front to rear. In a normal installation of the luminaire adjacent a straight roadway, the reflector is positioned so that the aforesaid vertical plane is perpendicular to the direction of the roadway, and the light distribution is such that the light beams from opposite sides of reflector 3 are directed respectively up and down the roadway. At street intersections or curves in the roadway, however, it may be desirable to orient the light distribution in a somewhat different direction to provide optimum lighting of the street intersection or curve, in which case reflector 3 is rotated to a different position within housing 2 to achieve the desired light distribution. Another situation in which suitable rotation of reflector 3 may be desired is where a group of luminaires are mounted in a ring on the same pole, and reflectors in those luminaires which are at different angular positions relative to the roadway need to be rotated in order to direct the light therefrom properly on the roadway surface.

While the present invention has been described with reference to particular embodiments thereof, it will be understood that numerous modifications may be made by those skilled in the art without departing from the scope of the invention. Therefore, the appended claims are intended to cover all such equivalent variations as come within the true spirit and scope of the invention.

What we claim as new and desire to secure by Letters Patent of the United States is:

1. A luminaire comprising, in combination, a concave housing having a bottom opening, a concave reflector arranged within said housing and having a rim defining a bottom opening substantially coaxial with the bottom opening of said housing, the rim of said reflector being substantially channel-shaped and being formed with an annular flange projecting upwardly and spaced outwardly from the reflector, means for removably mounting a lamp in said reflector, said reflector being rotatably adjustable within said housing about the axis thereof, and a plurality of circumferentially spaced fastening means adjustably securing said reflector rim flange to said housing for holding said reflector in different rotational positions relative to said housing, whereby the light distribution from said reflector may be varied, each said fastening means including support means secured to and having a portion projecting radially inwardly from said housing for supporting said reflector, said reflector being formed in said rim thereof with circumferentially spaced, outwardly open recesses, said recesses being sufficiently large for passage therethrough of said radially projecting support portions when said reflector is removed from and inserted into said housing, each said fastening means including a clamp member adjustably attached to said housing for releasably clamping said reflector rim flange to said housing.

2. A luminaire as defined in claim 1, said fastening means including screw means passing radially through said housing and said support means and connected to said clamp member for adjustably attaching the same to said housing.

3. A luminaire as defined in claim 1, said lamp mounting means being secured to said reflector for movement therewith about said axis.

4. A luminaire as defined in claim 3, said reflector being formed to produce asymmetric distribution of light therefrom.

5. A luminaire as defined in claim 1, said support means comprising an L-shaped member arranged between said annular flange of said reflector rim and said housing.

* * * * *